US005894825A

United States Patent [19]

Duerr

[11] Patent Number: 5,894,825

[45] Date of Patent: Apr. 20, 1999

[54] ENGINE LUBRICATION SYSTEM

[75] Inventor: Werner Chester Duerr, Westchester, Ill.

[73] Assignee: General Motors Corporation, Detroit, Mich.

[21] Appl. No.: 09/025,878

[22] Filed: Feb. 19, 1998

[51] Int. Cl.[6] ..... F01M 1/00

[52] U.S. Cl. ..... 123/196 S; 123/196 R; 184/6.4; 417/217

[58] Field of Search ..... 123/196 S, 196 R; 184/6.4; 417/217

[56] References Cited

U.S. PATENT DOCUMENTS 4,628,877 12/1986 Sundles et al. ..... 123/196 S
5,372,219 12/1994 Peralta ..... 123/196 S

*Primary Examiner*—Noah P. Kamen
*Assistant Examiner*—Jason A. Benton
*Attorney, Agent, or Firm*—Karl F. Barr, Jr.

[57] ABSTRACT

The present invention relates to a supplementary lubrication system for an internal combustion engine operable to lubricate the engine and an accessory prior to engine start-up and to lubricate the accessory after engine shut-down. The supplementary lubrication system includes an oil source in fluid communication with a supplemental oil supply conduit, which branches to define two parallel conduits, a prelube branch and a postlube branch. Disposed within the prelube branch is a prelube one-way check valve and disposed within the postlube branch is a postlube one-way check valve. The prelube branch is in fluid communication with a first end of a two-directional pump and the postlube branch is in fluid communication with a second end of the two-directional pump. During prelubrication the two-directional pump operates in a first direction to draw oil through the prelube branch and to pump oil through a prelube conduit extending from the second end of the two-directional pump, to deliver oil to the engine and the accessory. During postlubrication the two-directional pump operates in a second direction to draw oil through the postlube branch and to pump oil through a postlube conduit extending from the first end of the two-directional pump to deliver oil to the accessory.

3 Claims, 1 Drawing Sheet

ENGINE LUBRICATION SYSTEM

TECHNICAL FIELD

The present invention relates to a supplementary lubrication system for internal combustion engines with turbochargers.

BACKGROUND OF THE INVENTION

When an engine is not operated for a period of time, the engine oil drains down into the reservoir, leaving the engine components less than optimally lubricated. During engine start-up, unlubricated surfaces contact causing frictional wear before the engine oil pump can circulate an adequate oil supply. One approach to alleviate this concern is to provide a prelubrication system. This system may require a separate supply conduit and a separate external motor driven pump to lubricate the engine and turbocharger before engine start-up.

During hot shut-down of an engine with a turbocharger, the turbocharger will continue to spin for a period after the engine oil pump has shut off. Heat may build up as the bearings are not lubricated during this time. It is desirable to maintain lubrication flow to reduce soakback heat and frictional wear to extend bearing life. One solution is to provide a postlubrication system. Such a system may require an external motor driven pump and a designated conduit system.

Many engine applications use two separate systems described above to accomplish pre and postlubrication. Dual systems require separate controls, conduit system, motors and pumps, which increase cost, weight, and packaging requirements.

SUMMARY OF THE INVENTION

The invention provides a supplemental lubrication system to prelubricate both an engine and its accompanying turbocharger and postlubricate the turbocharger. One motor driven two-directional pump operates both functions. The two-directional pump serves to direct oil flow to either one or both the engine and the turbocharger, dependent on the function.

DESCRIPTION OF THE PREFERRED EMBODIMENT

Figure 1:
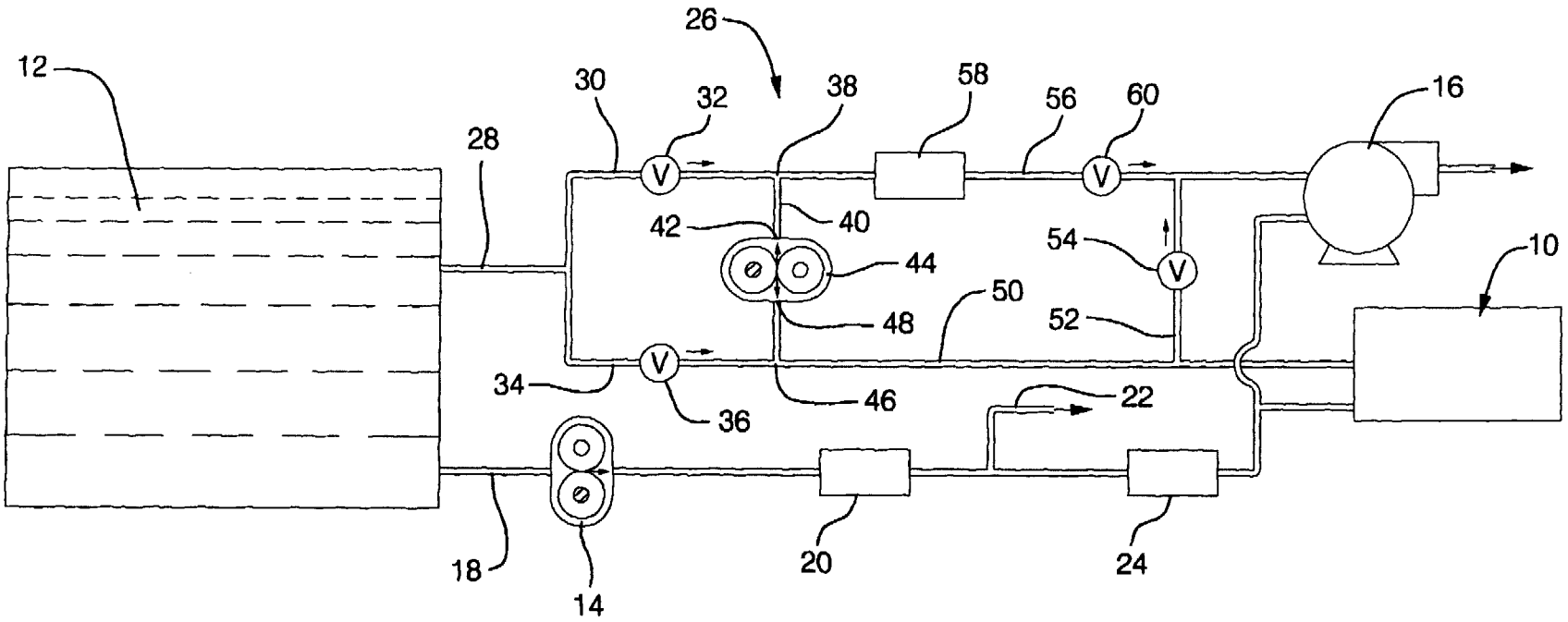
FIG. 1 is a schematic diagram of a mechanical engine lubrication system according to an embodiment of the present invention.

In FIG. 1 during primary lubrication of an internal combustion engine 10, while the engine is running, oil is drawn from an oil source 12 by a main oil pump 14. Oil under pressure is delivered to the engine 10 and to an accessory 16 such as a turbocharger through a primary supply conduit 18. Optional devices that may be disposed along the primary supply conduit 18 include an oil filter 20, an air vent line 22 for venting air purged from the oil, and an oil cooler 24, as required by the engine application.

In a supplemental lubrication system, shown generally as 26, a supplemental supply conduit 28 is in fluid communication with the oil source 12. The supplemental supply conduit 28 branches into two parallel conduits, a prelube branch 30 with a prelube one-way check valve 32 and a postlube branch 34 with a postlube one-way check valve 36.

The prelube branch 30 joins into a first end 38 of a pump conduit 40 which is in fluid communication with a first end 42 of a two-directional pump 44 and the postlube branch 34 joins into a second end 46 of the pump conduit 40 which is in fluid communication with a second end 48 of the two-directional pump 44. The pump is a device that can operate in either direction of rotation thereby providing flow in two directions. The pump may be driven by a three phase AC motor with input from a control module, not shown.

A prelube conduit 50 extends from the second end 46 of the pump conduit 40. The prelube conduit 50 branches to the engine 10 and to a turbo conduit 52 with a first turbo check valve 54. The turbo conduit 52 communicates with the bearing housing of the turbocharger 16.

A postlube conduit 56 extends from the first end 38 of the pump conduit 40. An optional postlube filter 58 may be disposed along the postlube conduit 56. Downstream of an optional postlube filter 58, a second turbo check valve 60 is disposed along the postlube conduit 56. The postlube conduit 56 then joins the turbo conduit 52 communicating with the bearing housing of the turbocharger 16.

During engine and turbocharger prelubrication, oil is drawn out of the oil source 12 and into the supplemental supply conduit 28 by the two-directional pump 44 operating in a first direction. Oil is drawn into the prelube branch 30, through the prelube one-way check valve 32, and into the pump conduit 40 through the two-directional pump 44. Oil is pumped into the prelube conduit 50 where a portion of oil is delivered to the engine 10. Another portion of oil flows through the turbo conduit 52 and the first turbo check valve 54, and is delivered to the bearing housing of the turbocharger 16. Prelubrication oil is prevented from back flowing through the postlube conduit 56 by the second turbo check valve 60.

During turbocharger postlubrication, the two-directional pump 44 is reversed to operate in a second direction. Oil is drawn out of the oil source 12 and into the supplemental supply conduit 28 by the two-directional pump 44. It is drawn into the postlube branch 34, through the postlube one-way check valve 36, and into the pump conduit 40 through the two-directional pump 44. Oil is pumped into the postlube conduit 56 through the second turbo check valve 60, and to the turbo conduit 52 entering the bearing housing of the turbocharger 16. Postlubrication oil is prevented from back flowing to the engine 10 by the first turbo check valve 54.

The two-directional pump 44 operates to generate a multi-mode supplemental lubrication. Operating the pump 44 in a first direction provides oil flow for prelubrication, while operating the pump in a second direction provides oil flow for postlubrication. Other powertrain components could be supplied oil by a similar supplemental lubrication system.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiments were chosen to provide illustrations of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. A supplemental lubrication system for an internal combustion engine operable to lubricate said engine and an accessory prior to engine start-up and to lubricate said accessory after engine shut-down comprising:

an oil source, a two-directional pump, said two-directional pump operable in a first direction for prelubrication to pump oil from said oil source to said engine and to said accessory, and said two-directional pump operable in a second direction for postlubrication to pump oil from said oil source to said accessory.

2. A supplemental lubrication system for an internal combustion engine operable to lubricate said engine prior to engine start-up and to lubricate an accessory after engine shut-down comprising:

an oil source, a supplemental oil supply conduit in fluid communication with said oil source, said supplemental oil supply conduit branching to define two parallel conduits, a prelube branch and a postlube branch, disposed within said prelube branch is a prelube one-way check valve, disposed within said postlube branch is a postlube one-way check valve, said prelube branch is in fluid communication with a first end of a two-directional pump and said postlube branch is in fluid communication with a second end of said two-directional pump, during prelubrication said two-directional pump operable in a first direction to draw oil through said prelube branch and to pump oil through a prelube conduit extending from said second end of said two-directional pump, to deliver oil to said engine, during postlubrication said two-directional pump operable in a second direction to draw oil through said postlube branch and to pump oil through a postlube conduit extending from said first end of said two-directional pump to deliver oil to said accessory.

3. A supplemental lubrication system according to claim 2, wherein during prelubrication oil is delivered to said accessory for accessory prelubrication.

* * * * *